US006073435A

United States Patent [19]

Koltze et al.

[11] Patent Number: 6,073,435

[45] Date of Patent: Jun. 13, 2000

[54] CENTRIFUGAL SPINNING AND WINDING MACHINE

[75] Inventors: Karl Koltze; Karl-Heinz Bruss, both of Mönchengladbach, Germany

[73] Assignee: W. Sclafhorst AG & Co., Germany

[21] Appl. No.: 09/223,585

[22] Filed: Dec. 30, 1998

[30] Foreign Application Priority Data

Jan. 24, 1998 [DE] Germany ..... 198 02 653

[51] Int. Cl.[7] ..... D01H 9/10

[52] U.S. Cl. ..... 57/76; 57/281; 57/312; 57/74; 57/75; 57/76; 57/77; 57/90; 57/264; 57/266; 57/313; 242/18 R

[58] Field of Search ..... 242/18 R; 57/281, 57/312, 74, 75, 76, 77, 90, 264, 266, 276, 313

[56] References Cited

U.S. PATENT DOCUMENTS

| | | | |
|---|---|---|---|
| 5,185,993 | 2/1993 | Fritschi et al. | 57/281 |
| 5,289,674 | 3/1994 | Badiali et al. | 57/281 |
| 5,337,551 | 8/1994 | Grecksch et al. | 57/281 |
| 5,369,946 | 12/1994 | Pujol-Isern | 57/312 |
| 5,497,952 | 3/1996 | Iding | 242/18 R |
| 5,515,672 | 5/1996 | Koltze et asl. | 57/281 |

FOREIGN PATENT DOCUMENTS

| | | |
|---|---|---|
| 250 961 A1 | 10/1987 | Germany . |
| 40 00 107 A1 | 9/1990 | Germany . |
| 40 02 249 A1 | 9/1990 | Germany . |
| 43 24 039 A1 | 1/1995 | Germany . |
| 195 27 002 A1 | 1/1997 | Germany . |
| 195 31 147 A1 | 2/1997 | Germany . |
| 195 48 668 A1 | 6/1997 | Germany . |
| 548 460 | 6/1972 | Switzerland . |

*Primary Examiner*—John J. Calvert
*Assistant Examiner*—Mary K. Fiore
*Attorney, Agent, or Firm*—Kennedy Covington Lobdell & Hickman

[57] ABSTRACT

A centrifugal spinning and winding machine (23) with a plurality of work stations (1) arranged in series. The work stations (1) comprise several autonomous centrifugal spinning units (2), an associated winding device (5), and an associated storage device (4) located between the centrifugal spinning units (2) and the winding device (5) and having at least one storage path (31) for holding spinning cops (16) and at least one waiting path (33) for holding empty bobbin tubes (11) for supply to the spinning units and the winding device.

22 Claims, 7 Drawing Sheets

CENTRIFUGAL SPINNING AND WINDING MACHINE

BACKGROUND OF THE INVENTION

The present invention relates to a centrifugal spinning and winding machine, sometimes referred to as pot spinning, comprising in combination a plurality of work stations each having plural centrifugal spinning units and an associated winding device.

Various devices are known in centrifugal pot spinning and winding machines in which two or more spinning centrifuges are associated with a joint winding device. Swiss patent 548,460 describes, for example, a device in which a roving or sliver drawn off of a speed frame bobbin or a flyer bobbin is fed via a draw frame or other drafting device alternatingly into two adjacent spinning centrifuges. The device operates according to a two-stage centrifugal spinning process. That is, the drawn roving yarn receives at first only a part of its final twist when fed into the spinning centrifuge. As soon as the first spinning centrifuge has been filled the roving yarn is cut and the end of the roving yarn connected to the speed frame bobbin is fed into the second spinning centrifuge. At the same time the partially spun yarn is drawn out of the first spinning centrifuge and wound on a winding device to a cross-wound bobbin, during which the yarn thereby receives its final twist. The procedure is repeated in a corresponding manner as soon as the second spinning centrifuge has been filled.

Comparable devices also operating according to the two-stage centrifugal spinning process with several spinning centrifuges per winding unit are also described in German Patent Publications DD 250 961 A1, DE 40 00 107 A1 or DE 40 02 249 A1.

However, the two-stage centrifugal spinning process has the disadvantage that the yarn is not yet finished when it is drawn out of the spinning centrifuge, that is, it has only a part of its final twist. The material is therefore extremely sensitive. Accordingly, when the yarn is drawn off out of the spinning centrifuge, losses of yarn body due to yarn breaks frequently are difficult to avoid. Even the locating of the yarn end inside the centrifuge customary in yarn breaks exerts a negative influence on the degree of efficiency of the devices in question.

Not only a greater yarn strength but also a distinctly greater spinning safety, and therewith also a higher degree of machine efficiency, can be achieved with devices operating according to a one-stage centrifugal spinning process. In this known process, a roving drawn from a draw frame is first fed onto the wall of a spinning centrifuge rotating at a high speed.

However, the infeed rate of the roving and the speed of the spinning centrifuge are adapted to one another in such a manner that a spinning cake is deposited on the centrifuge wall in the form of a finished yarn. When this spinning cake has reached a predetermined size, a rewinding process is initiated. That is, a rewinding bobbin tube, e.g. held on a yarn guide tube by which the yarn is delivered into the centrifuge, is lowered into the spinning centrifuge and grasps the rotating yarn extent exiting out of the yarn guide tube. As a result, the yarn cake is then wound from the inner wall of the centrifuge onto the rewinding bobbin tube. The spinning cop produced is removed out of the spinning centrifuge by a doffing device and subsequently rewound to a large-volume cross-wound bobbin on a winding device.

A centrifugal spinning and winding machine operating in accordance with the above-described one-stage centrifugal spinning process is described, for example, in German Patent Publication DE 195 31 147 A1. This known textile machine constructed in a longitudinal design comprises multiple (e.g. 100) adjacent work stations with at least one spinning centrifuge rotating about a vertical axis. An individual doffer with a permanently installed rewinding bobbin tube is associated with each spinning centrifuge, which bobbin tube is introduced downwardly into the spinning centrifuge from thereabove to take up the spinning cake deposited on the centrifuge wall. The doffer subsequently transfers the finished spinning cop out of the centrifuge and into a special vacuum chamber. In addition, a yarn connecting unit is arranged for traveling movement along the work stations of this known centrifugal spinning and winding machine for connecting the yarn end of the spinning cop detached in the vacuum chamber in a splicing device to the yarn end of a cross-wound bobbin held in a winding device.

The above-described centrifugal spinning and winding machine is not only relatively complicated and expensive in its design but the design of its doffing device is also disadvantageous. That is, the doffing device operates with a rewinding bobbin tube arranged permanently on the doffing device, which results in problems, e.g. in the case of cops having residual yarn windings, and significantly limits the flexibility of the device.

SUMMARY OF THE INVENTION

In view of the previously described state of the art, the present invention seeks to address the problem of improving the known centrifugal spinning and winding machines.

The invention addresses this problem by providing a centrifugal spinning and winding machine which basically comprises a plurality of work stations each having plural centrifugal spinning units and a winding device associated with the several spinning units. According to the present invention, each work station is further equipped with an associated storage device located between the centrifugal spinning units and the winding device for transferring yarn bodies (e.g. wound spinning cops) and empty yarn-body carriers (e.g. empty spinning tubes) between the spinning units and the winding device.

The provision of the work stations of a centrifugal spinning and winding machine with separate storage devices arranged between the centrifugal pot spinning units and the associated winding devices advantageously results in a decoupling of the spinning and winding work cycles. That is, since the storage devices act as a buffer separating the spinning and winding work cycles, it is assured that problems in the area of one of the work cycles do not also have an immediate effect on the other work cycle. It is therefore assured that sufficient empty bobbin tubes are always available on the spinning centrifuges for the doffing procedures and sufficient spinning cops are always available on the winding device for the winding process. On the whole, a textile machine with such storage devices in association with the work stations is far less susceptible to problems of inefficiency, especially as regards rather small operational disturbances, than the known devices and therefore has a greater efficiency of utilization.

A further advantage of the provision of storage device specific to a given associated work station or stations is that a direct association of the spinning cops to the spinning centrifuges on which the cops were produced is possible via the sequence with which the spinning cops are supplied to the winding device. Therefore, an expensive identification device for spinning cops can be eliminated in the case of the device of the present invention.

As a rule, a predetermined number of centrifugal spinning units, typically limited for example to four or eight spinning units, are connected via an individual storage device to a given associated winding device whose normal winding speed is distinctly greater than the spinning speed of the spinning units, e.g., well over eight times the spinning speed. Thus, it is possible with the present centrifugal spinning and winding machine to throttle back the winding speed, which has a positive effect on the quality of the cross-wound bobbin produced.

On the whole, quality products can be obtained with the device of the invention in a simple manner with degrees of machine efficiency which clearly exceed the degrees of efficiency of known centrifugal spinning and winding machines.

The storage device is preferably designed to be capable of stowing backup spinning cops. As a result, the storage device becomes independent of the transport speed of its transport devices and of the work rhythm of the spinning and/or winding device.

More specifically, in a preferred embodiment, the storage device has at least one transport path on which the items to be transported (yarn cops or empty cop tubes) can be temporarily placed. The transport path(s) form(s) on the one hand a storage path for cops and on the other hand a waiting path for empty cop tubes. For example, drivable belts, rotating disks or similar low-maintenance transport means are arranged in the area of the storage path and the waiting path for the transport of the items to be transported, which are typically standing on transport plates which can be accumulated in alignment.

An advantageous embodiment to the invention arranges the centrifugal spinning units in a circle and served such arrangement of spinning units via one or more pivotably arranged doffing devices. It is advantageous thereby if one doffing device serves at least two centrifuge spindles. However, it is equally possible to use a common doffing device for a greater number, e.g. four, of centrifuge spindles.

In a preferred embodiment, the storage device has a storage path with an infeed location for spinning cops as well as a waiting path with a discharge location for empty bobbin tubes. The grasping device of the doffing device reaches over these two paths in the area of the infeed location and discharge location. Spinning cops can be readily transferred to the storage device and empty bobbin tubes removed from the storage device via these intersections of the grasping device of the doffing device with the afore-mentioned transport paths of the storage device connected to the winding device. Both the storage path for the spinning cops and the waiting path for the empty bobbin tubes are preferably dimensioned so that several of the circulating items transported on transport plates can be parked at the same time.

According to an advantageous alternative embodiment of the invention, each work station may comprise several centrifugal spinning units arranged adjacent to each other in a series. Such a serial arrangement of the centrifugal spinning units results in a centrifugal spinning and winding machine which is especially easy to maintain since in this instance all working elements of the spinning and winding machine are readily accessible to the service personnel.

An especially flexible connection of the centrifugal spinning units to the storage device is provided if a separate individual doffing device is associated with each centrifugal spinning unit. Such an arrangement makes it possible to doff immediately the centrifugal spinning units, which are preferably arranged in a series, so that the standstill times of the centrifuge spindles can be minimized. The individual doffing devices transmit and/or receive their doffing items to/from a transverse transport path arranged with advantage immediately behind the doffing devices. The transverse transport path connects the waiting path for the empty bobbin tubes to the storage path for the spinning cops.

Another advantageous variant provides that the centrifugal spinning units of a work station are supplied via a common doffing device which can travel along the centrifugal spinning units. The doffing device can be in various embodiments. It is possible, for example, to design the doffing device so that it can be shifted linearly in such a manner that the doffing element can be delivered as needed to each centrifugal spinning unit of one or several work stations arranged in series.

An advantageous embodiment of such a movable doffing device is provided if the doffing device comprises a base frame which is disposed between the centrifugal spinning units and the winding device and can travel along the spinning units. A doffing element mounted in a shiftable manner may be arranged on the base frame or a stationary doffing element can be arranged on this movable base frame. Moreover, in the instance of a stationary doffing element, the base frame comprises at least one transport device arranged at the outlet or downstream side of the doffing device.

The previously described embodiments result in efficient high production doffing devices which reliably transfer the spinning cops produced in the centrifugal spinning units to the storage device arranged in the area of the winding device and fetch the empty bobbin tubes from the storage device.

Further details, features and advantages of the present invention are explained below with reference to the exemplary embodiments presented in the accompanying drawings.

DESCRIPTION OF THE PREFERRED EMBODIMENT

Figure 1:
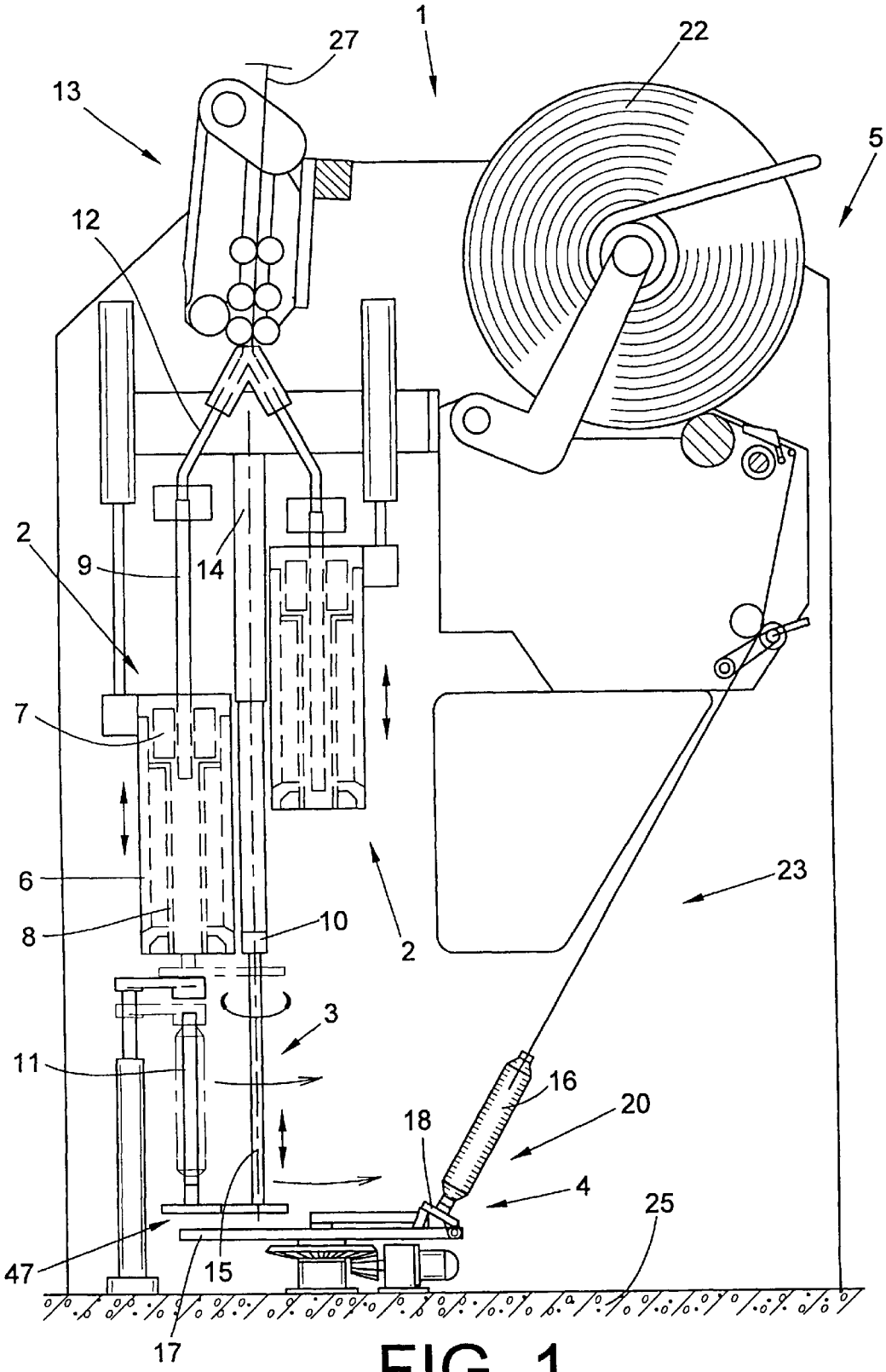
FIG. 1 is a side elevational view of a work station of a centrifugal spinning and winding machine according to the present invention, as viewed along line I—I in FIG. 2.

Referring now to the accompanying drawings and initially to FIG. 1, a work station, presented in a lateral view, of a centrifugal spinning and winding machine 23 is designated overall by reference numeral 1. Work station 1 comprises several centrifugal spinning units 2, one or more doffing devices 3, a storage device 4 and a winding device 5.

Centrifugal spinning units, which are also designated as pot spinning devices, are known in the state of the art and have been described in a relatively detailed manner such as in German Patent Publication DE 42 08 039 A1.

Such centrifugal spinning units basically comprise a spinning centrifuge 8 rotatably supported in a jacket housing 6 and driven by a single electric motor 7. Yarn guide tube 9 is introduced downwardly from above into this spinning centrifuge 8 and doffing device 3 can be moved upwardly into spinning centrifuge 8 from below. As is known, an empty bobbin tube 11 is detachably fixed to yarn guide tube 9 for receiving the yarn from within the centrifuge after which the bobbin tube can be detached from the yarn guide tube to function as a rewinding tube.

In the exemplary embodiment shown, yarn guide tube 9, which is connected via roving-yarn guide conduit 12 to draw frame 13, is arranged stationarily whereas jacket housing 6 is supported so that it can be shifted vertically. Doffing device 3 can be moved vertically via a schematically indicated drive 14 and is supported so that it can pivot about pivot axis 15 e.g. via drive 10.

Storage device 4 of the invention can have various designs. Rotary disk 17 can be provided, for example, as shown schematically in FIG. 1, to transport yarn bodies (e.g. spinning cops 16) supported on transport plates 18 from infeed location 19 to winding position 20 and to return empty yarn body carriers (e.g. empty bobbin tubes 11) on transport plates 18 from winding position 20 to discharge location 21. Transport plates 18 are guided during the transport, as is customary, in appropriate guide elements (not shown). Spinning cops 11 are rewound in winding position 20 into a large-volume cross-wound bobbin 22. The constructive design of the winding device 5 is known in the state of the art, so that no further description should be necessary.

Figure 2:
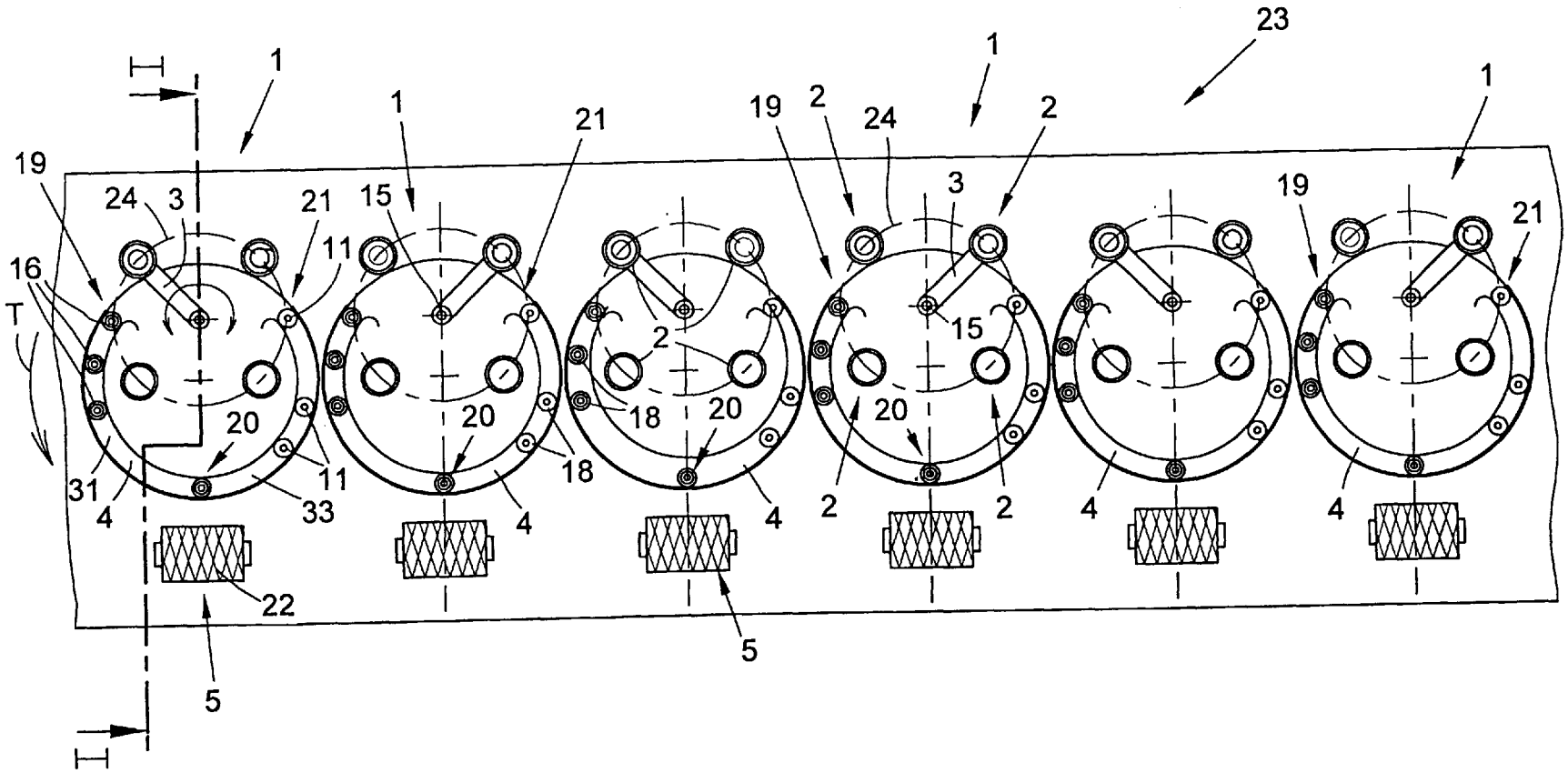
FIG. 2 is a schematic top plan view of a centrifugal spinning and winding machine according to the present invention, in an embodiment having the storage devices in accordance with the invention arranged a single-row.

FIG. 2 shows a schematic top view of the arrangements of various working and transporting components of a centrifugal spinning and winding machine having work stations 1 arranged in series. As is known, such a centrifugal spinning and winding machine 23 can comprise a hundred or more of such adjacent work stations 1. In the exemplary embodiment shown, each work station 1 has four centrifugal spinning units 2 arranged in a circular track 24, with the four spinning units 2 supplied via a common doffing device 3. Doffing device 3 is supported so that it can pivot about pivot axis 15 such that its grasping device 47 (see FIG. 1; not shown in FIG. 2) arranged on a grasping arm to extend over the transport path of storage device 4 in the area of the infeed location 19 and in the area of the discharge location 21. Winding position 20, in which spinning cops 16 are rewound to cross-wound bobbins 22, is located approximately midway between infeed location 19 and discharge location 21.

Figure 3:
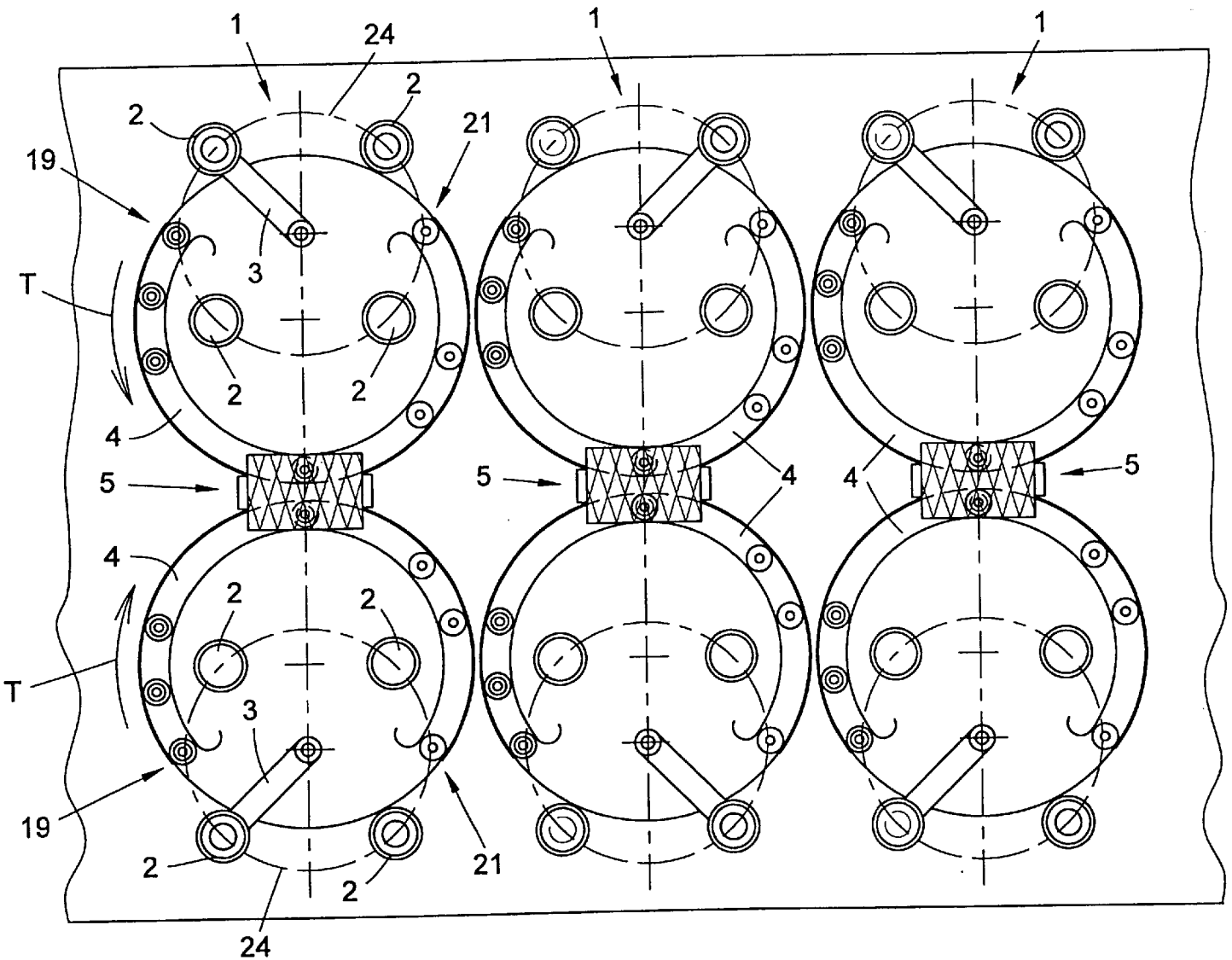
FIG. 3 is another schematic top plan view, similar to FIG. 2, of a centrifugal spinning and winding machine according to the present invention, in an embodiment having the storage devices in accordance with the invention arranged a double-row.

FIG. 3 depicts a similar centrifugal spinning and winding machine 23, but wherein work stations 1 comprise two rows with circularly arranged centrifugal spinning units 2, whereby eight centrifugal spinning units 2 are associated with a common winding device 5.

Figure 4:
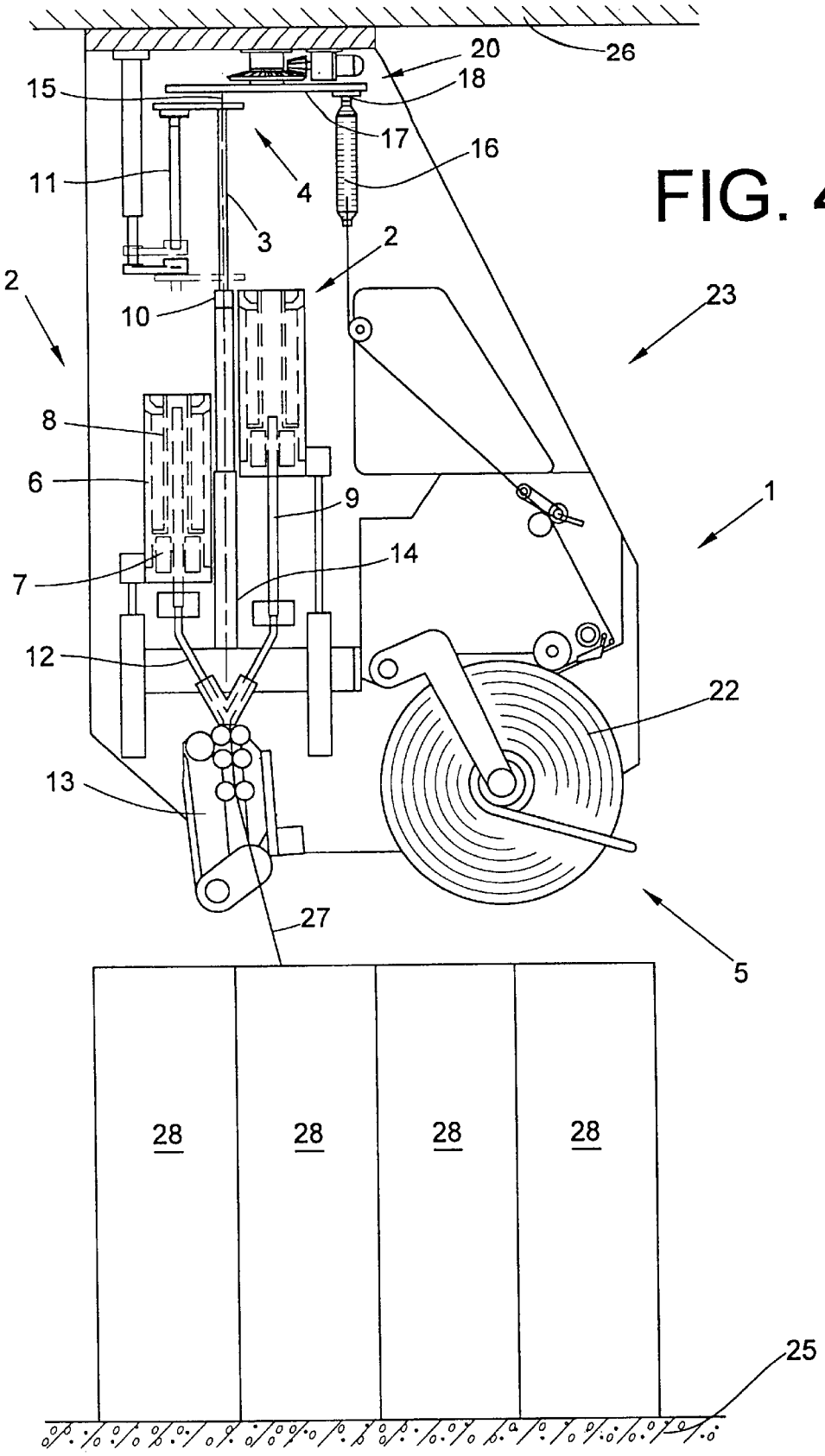
FIG. 4 is another side elevational view, similar to FIG. 1, of another embodiment of a work station of a centrifugal spinning and winding machine according to the present invention.
Figure 5:
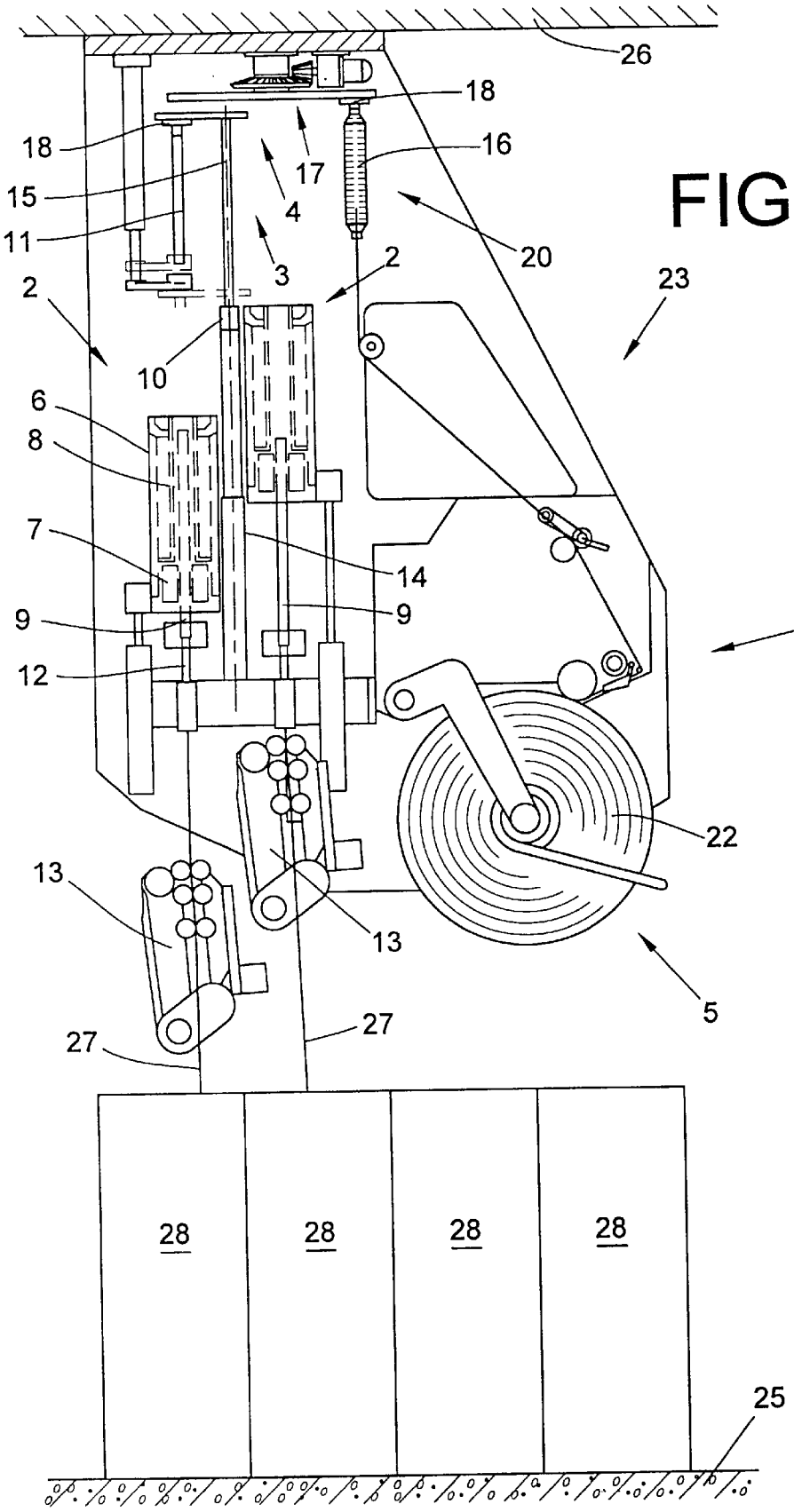
FIG. 5 is another side elevational view, similar to FIGS. 1 and 4, of a third embodiment of a work station of a centrifugal spinning and winding machine according to the present invention.

The exemplary embodiments shown in FIGS. 4 and 5 differ from the exemplary embodiment of FIG. 1 solely in the arrangement of their working parts. That is, in the exemplary embodiment according to FIG. 1, the machine frame of centrifugal spinning and winding machine 23 stands on floor 25 and the infeed of roving yarn 27 into draw frame 13 takes place from above. Centrifugal spinning and winding machines 23 shown in FIGS. 4, 5 are fixed to ceiling 26 or are suspended on a carrier construction (which can be supported on floor 25) arranged in the area of the ceiling. The infeed of the feed material into draw frame(s) 13 takes place from below the spinning and winding machine, the feed material in this instance being sliver 27 stored in spinning cans 28 positioned below work parts 2,5 of centrifugal spinning and winding machine 23. Storage device 4 in accordance with the present invention is arranged in the area of ceiling 26 and corresponds essentially to the embodiment already presented in FIG. 1. In the exemplary embodiment according to FIG. 4, two centrifugal spinning units 2 are alternatingly served by common draw frame 13. In contrast, in the exemplary embodiment of FIG. 5, a separate draw frame 13 is provided for each of centrifugal spinning units 2.

Figure 6:
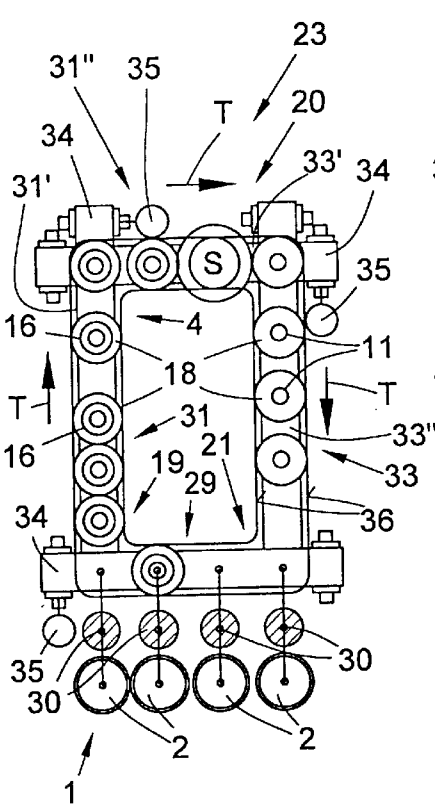

FIG. 6 schematically depicts an embodiment of a centrifugal spinning and winding machine 23 in which centrifugal spinning units 2 of a work station 1 are aligned adjacent to each other in series. Individual doffing devices 30 are positioned behind each of centrifugal spinning units 2 to transfer spinning cops finished in spinning units 2 onto transverse conveyor belt 29 arranged behind individual doffing devices 30 and to take up empty bobbin tubes 11 from transverse conveyor belt 29. Spinning cops 16 transferred onto conveyor belt 29 pass via infeed location 19 onto storage device 4 by which spinning cops 16 are transported in direction of transport T along storage path 31 to winding position 20. Storage path 31 consists of storage-path sections 31' and 31", section 31" extending directly into the area of winding position 20. Winding position 20 is followed by waiting path 33 for empty bobbin tubes 11, this waiting path 33 similarly consisting of path sections 33' and 33".

The spinning cops 16 and empty bobbin tubes 11 are preferably transported along the transport paths 31, 33 and in the area of storage device 4 while supported in upstanding disposition on transport plates 18 (sometimes referred to as pallets or peg trays) resting on conveyor belts 34 loaded by drives 35. Moreover, transport plates 18 are guided, as is customary, in lateral guide devices 36.

Figure 7:
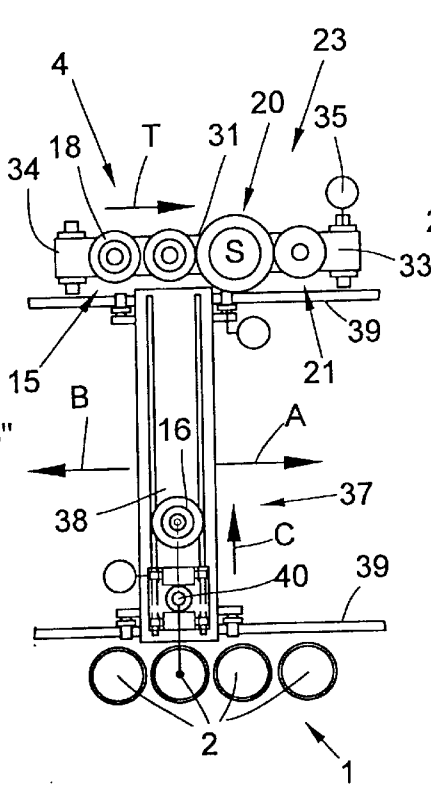

In the exemplary embodiment according to FIG. 7, the supply of aligned centrifugal spinning units 2 with cops takes place via doffing device 37 which can travel laterally in directions A and B alongside a plurality of spinning units. This doffing device 37 comprises base frame 38 supported in such a manner that it can travel on tracks 39 or like guides along centrifugal spinning units 2 to be delivered as required to each centrifugal spinning unit 2 of work station 1.

Doffing element 40 is arranged on base frame 38 and can be shifted in direction C orthogonally to direction of travel A, B of the base frame. Doffing element 40 transfers spinning cops 16 out of centrifugal spinning units 2 directly onto infeed location 19 of storage device 4 installed in the area of winding position 20. Storage device 4 consists in the present exemplary embodiment of a linear transport path subdivided into storage path 33 and a short waiting path 31 on opposite sides of winding position 20.

Figure 9:
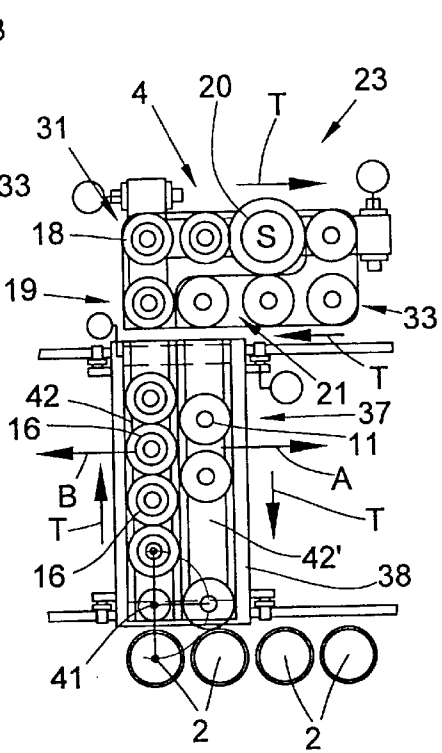
FIGS. 6–13 are schematic top plan views showing various alternative embodiments of doffing devices for loading and unloading a storage device connected to the winding device in a centrifugal spinning and winding machine in accordance with the present invention.
Figure 8:
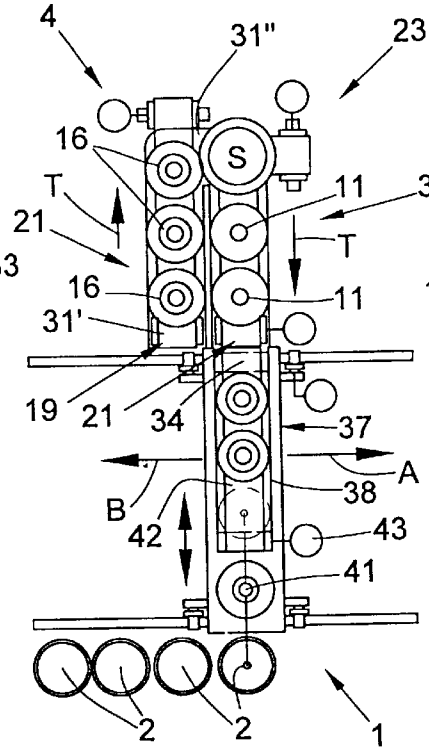

FIGS. 8 and 9 show a similarly designed work station 1 of a centrifugal spinning and winding machine wherein four centrifugal spinning units 2 aligned in series are served by a movable doffing device 37. However, doffing device 37 comprises on its base frame 38 a stationary doffing element 41 and one or more transport path(s) 42 and 42'.

According to the embodiment of FIG. 8, doffing device 37 comprises transport path 42 whose conveyor belt 34 can be driven by reversible electric motor 43. By movement of the doffing device 37 laterally along its tracks, transport path 42 can be selectively connected to infeed location 19 or discharge location 21 of storage device 4. Storage device 4 comprises a storage path 31 with path sections 31' and 31" in this exemplary embodiment for spinning cops 16 as well as a waiting path 33 for empty bobbin tubes 11.

In the embodiment according to FIG. 9, two oppositely traveling transport paths 42, 42' are arranged on base frame 38 of movable doffing device 37 and storage device 4, slightly modified relative to the arrangement of FIG. 8, is arranged in the area of winding position 20 but rotated through 90° in comparison to then embodiment of FIG. 8. By lateral movement of the doffing device 37 along its tracks, transport paths 42, 42' can be connected respectively to infeed location 19 and discharge location 21 of storage device 4.

Figures 10, 11, 12, 13:
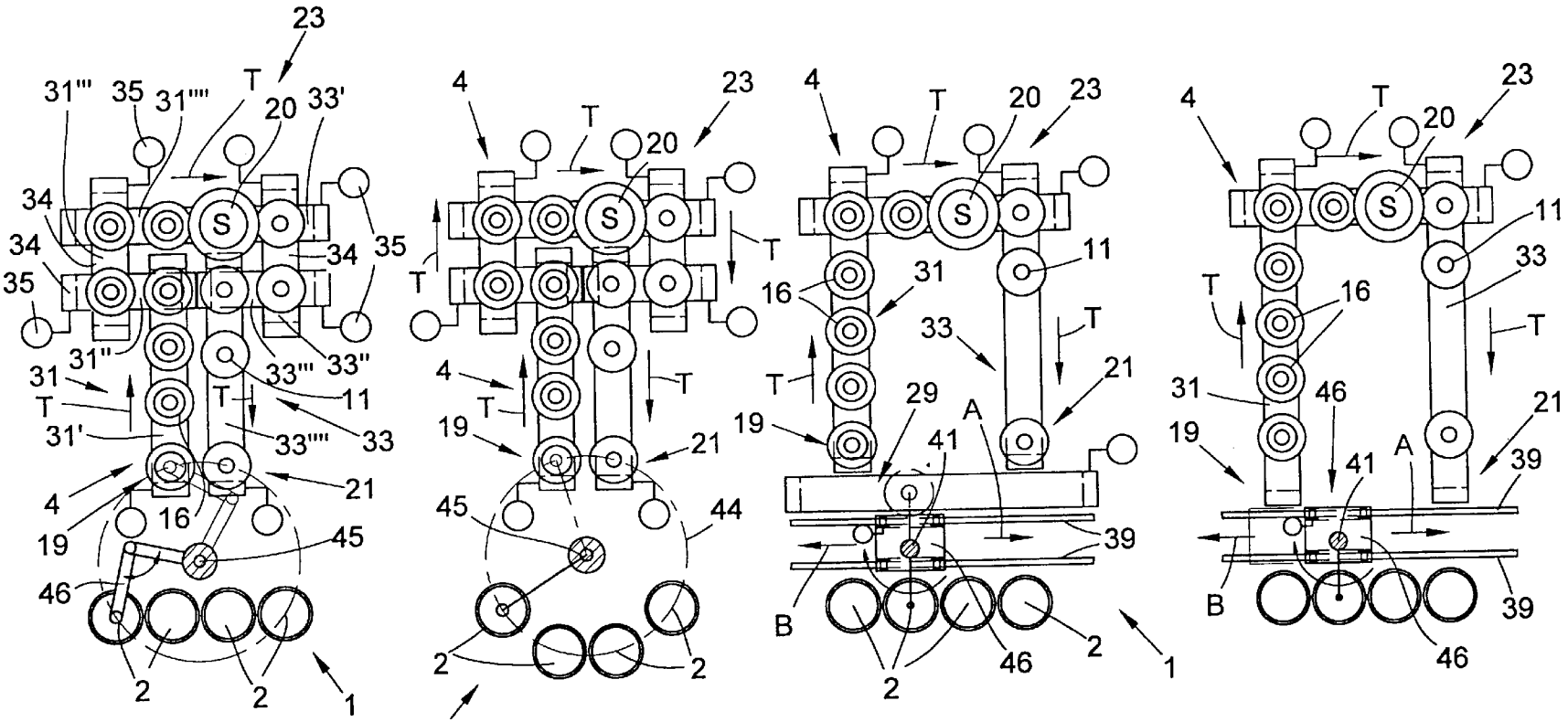

The exemplary embodiments of a work station 1 shown in FIGS. 10 and 11 differ from one another solely in the arrangement of centrifugal spinning units 2. Whereas centrifugal spinning units 2 in FIG. 10 are aligned in series, the centrifugal spinning units 2 in FIG. 11 are in a circular track 44.

In each embodiment, centrifugal spinning units 2 are supplied by stationary doffing device 45 comprising a doffing arm 46 which in the embodiment of FIG. 10 which can be varied in length. As is already known from the previously described exemplary embodiments, storage device 4 comprises storage path 31 for spinning cops 16 as well as waiting path 33 for empty bobbin tubes 11. Both storage path 31 as well as waiting path 33 are subdivided into storage-path sections 31' to 31"" and waiting-path sections 33' to 33"", respectively. Separate conveyor belts 34 driven preferably by electric motors 35 form these individual path sections.

The exemplary embodiment according to FIG. 12 corresponds to a significant extent to the exemplary embodiment of FIG. 1. However, in the exemplary embodiment of FIG. 12, movable doffing device 46 supported on tracks 39 is used instead of individual doffing devices, with the doffing element 41 of such movable doffing device 46 providing the connection between aligned centrifugal spinning units 2 and transverse transport path 29 of storage device 4.

The exemplary embodiment of FIG. 13 is similar to FIG. 12 but the transverse transport path 29 is omitted. In this embodiment, movably arranged doffing device 46 with doffing element 41 transfers spinning cops 16 directly to infeed location 19 of storage path 31 and takes empty bobbin tubes 11 up directly at discharge location 21 of waiting path 33.

The operation of the device in accordance with the invention may thus be understood, with reference to the embodiment of FIGS. 1 and 2 by way of example. The feed material is either a roving 27 from a speed frame bobbin (not shown), as in the exemplary embodiment of FIG. 1, or a sliver 27 supplied out of spinning can 28, as in the exemplary embodiments of FIGS. 4 and 5. In either case, the feed material for the spinning operation is fed into draw frame 13 wherein it is drawn and the drawn material is then delivered via guide conduit 12 and yarn guide tube 9 into spinning centrifuge 8. The rotation of spinning centrifuge at a high speed imparts the necessary twist to the drawn feed material, which then accumulates as finished yarn on the inner wall of the spinning centrifuge.

When this so-called spinning cake has achieved a given volume, it is rewound onto empty bobbin tube 11 held ready on yarn guide tube 9 as a rewinding bobbin tube, the rewinding process being initiated by the action of empty bobbin tube 11 sliding downward on yarn guide tube 9 to grasp the rotating yarn shank exiting out of yarn guide tube 9. The rewinding operation when completed results in production of a spinning cop on the empty tube 11. The cop is subsequently taken out of spinning centrifuge 8 by doffing device 3, transported into the area of storage device 4 of the present invention and transferred via infeed location 19 to storage path 31. Storage path 31 constantly maintains several spinning cops 16 in alignment and transports them one by one into the area of winding position 20 where the spinning cops are rewound to a large-volume cross-wound bobbin 22.

Unwound empty bobbin tubes 11 are discharged from the winding position 20 via waiting path 33 back to discharge location 21 of storage device 4 whereat empty bobbin tubes 11 can be grasped by doffing device 3. Doffing device 3 takes an empty bobbin tube 11, introduces it from below into the spinning centrifuge and positions it on yarn guide tube 9 of the particular spinning centrifuge. The spinning centrifuge is thereby readied for a new spinning cycle and the doffing device proceed on to service the next centrifugal spinning unit.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A centrifugal spinning and winding machine comprising a plurality of work stations, each said work station itself including:

(a) plural centrifugal spinning units, (b) an associated winding device, and (c) an associated storage device defining a travel path connecting said plural centrifugal spinning units of said work station only with said winding device of said work station for transferring yarn bodies and empty yarn-body carriers only between said spinning units and said winding device of said work station.

2. The centrifugal spinning and winding machine according to claim 1, wherein said travel path of said storage device comprises at least one storage path for yarn bodies comprising spinning cops and at least one waiting path for yarn-body carriers comprising empty spinning tubes.

3. The centrifugal spinning and winding machine according to claim 1, wherein said plurality centrifugal spinning units of each said work station are disposed in a circular arrangement and said work station further includes at least one pivotable doffing device.

4. The centrifugal spinning and winding machine according to claim 3, wherein sad travel path of a said storage device includes at least one storage path having an infeed location for yarn bodies comprising spinning cops and a waiting path having a discharge location for yarn-body carriers comprising empty spinning tubes, and wherein said doffing device includes a grasping device extendable over said travel path in the area of said infeed location and said discharge location.

5. The centrifugal spinning and winding machine according to claim 1, further comprising transport plates for conveyance of yarn bodies and yarn body carriers in the area of said storage device.

6. The centrifugal spinning and winding machine according to claim 1, wherein said plural centrifugal spinning units of each said work station are disposed in serial alignment adjacent to one other.

7. The centrifugal spinning and winding machine according to claim 6, wherein each said work station comprises a plurality of doffing devices each associated with a respective one of said centrifugal spinning units thereof.

8. The centrifugal spinning and winding machine according to claim 7, wherein said travel path of a said storage device includes a storage path having an infeed location for yarn bodies comprising spinning cops and a waiting path having a discharge location for yarn-body carriers comprising empty spinning tubes, and wherein each said work station comprises a transverse transport path in the area of said doffing devices for connecting said waiting path to said storage path.

9. The centrifugal spinning and winding machine according to claim 6, wherein each said work station includes a movable doffing device arranged in the area of said plural centrifugal spinning units.

10. The centrifugal spinning and winding machine according to claim 9, wherein said doffing device comprises a base frame movable along tracks between said plural centrifugal spinning units and said winding device.

11. The centrifugal spinning and winding machine according to claim 10, wherein said doffing device comprises a doffing element on said base frame that is shiftable orthogonally to the direction of travel of said base frame.

12. The centrifugal spinning and winding machine according to claim 10, wherein said doffing device comprises a stationary doffing element and at least one transport device on said movable base frame, said transport device being loadable and unloadable by said doffing element.

13. The centrifugal spinning and winding machine according to claim 1, wherein each said work station comprises several centrifugal spinning units in serial alignment adjacent to one other, and wherein said travel path of said storage device of each said work station comprises a storage path having an infeed location for yarn bodies comprising spinning cops and a waiting path having a discharge location for yarn-body carriers comprising empty spinning tubes, and wherein each said work station further comprises a movable doffing device and a transverse transport path connecting said waiting path and said storage path thereof.

14. A centrifugal spinning and winding machine comprising a plurality of work stations, each having plural centrifugal spinning units, an associated winding device, and an associated storage device located between the centrifugal spinning units and the winding device for transferring yarn bodies and empty yarn-body carriers between the spinning units and the winding device, wherein the centrifugal spinning units of each work station are in a circular arrangement and the work station further comprises at least one pivotable doffing device.

15. The centrifugal spinning and winding machine according to claim 14, wherein the storage device comprises at least one storage path having an infeed location for yarn bodies in the form of spinning cops and at least one waiting path having a discharge location for yarn-body carriers in the form of empty spinning tubes, and the doffing device comprises a grasping device extendable over the storage path in the area of the infeed location and over the waiting path in the area of the discharge location.

16. A centrifugal spinning and winding machine comprising a plurality of work stations, each having plural centrifugal spinning units, an associated winding device, and an associated storage device located between the centrifugal spinning units and the winding device for transferring yarn bodies and empty yarn-body carriers between the spinning units and the winding device, wherein each work station comprises several centrifugal spinning units in serial alignment adjacent to one other, and wherein each work station comprises a plurality of doffing devices each associated with a respective one of The centrifugal spinning units of the work station.

17. The centrifugal spinning and winding machine according to claim 16, wherein the storage device comprises at least one storage path having an infeed location for yarn bodies in the form of spinning cops and at least one waiting path having a discharge location for yarn-body carriers in the form of empty spinning tubes, and each work station comprises a transverse transport path in the area of the doffing devices for connecting the waiting path to the storage path.

18. A centrifugal spinning and winding machine comprising a plurality of work stations, each having plural centrifugal spinning units, an associated winding device, and an associated storage device located between the centrifugal spinning units and the winding device for transferring yarn bodies and empty yarn-body carriers between the spinning units and the winding device, wherein each work station comprises several centrifugal spinning units in serial alignment adjacent to one other, and wherein each work station comprises a movable doffing device arranged in the area of the centrifugal spinning units.

19. The centrifugal spinning and winding machine according to claim 18, wherein the doffing device comprises a base frame movable along tracks between the centrifugal spinning units and the winding device.

20. The centrifugal spinning and winding machine according to claim 19, wherein the doffing device comprises a doffing element on the base frame that is shiftable orthogonally to the direction of travel of the base frame.

21. The centrifugal spinning and winding machine according to claim 19, wherein the doffing device comprises a stationary doffing element on the movable base frame and at least one transport device on the movable base frame, the transport device being loadable and unloadable by the doffing element.

22. A centrifugal spinning and winding machine comprising a plurality of work stations, each having plural centrifugal spinning units, an associated winding device, and an associated storage device located between the centrifugal spinning units and the winding device for transferring yarn bodies and empty yarn-body carriers between the spinning units and the winding device, wherein each work station comprises several centrifugal spinning units in serial alignment adjacent to one other, and wherein the storage device of each work station comprises at least one storage path having an infeed location for yarn bodies in the form of spinning cops and at least one waiting path having a discharge location for yarn-body carriers in the form of empty spinning tubes, and each work station further comprises a movable doffing device and a transverse transport path connecting the waiting path and the storage path.

* * * * *